United States Patent [19]

Durkee

[11] 4,215,339

[45] Jul. 29, 1980

[54] ELECTRONIC CHIME

[75] Inventor: John E. Durkee, Hemlock, N.Y.

[73] Assignee: Emerson Electric Co., St. Louis, Mo.

[21] Appl. No.: 32,709

[22] Filed: Apr. 23, 1979

[51] Int. Cl.[2] ..... G08B 1/00

[52] U.S. Cl. ..... 340/384 E; 340/384 R

[58] Field of Search ..... 340/384 E, 384 R; 331/47

[56] References Cited

U.S. PATENT DOCUMENTS 4,001,816 1/1977 Yamada ..... 340/384 R

*Primary Examiner*—Harold I. Pitts

*Attorney, Agent, or Firm*—Polster, Polster and Lucchesi

[57] ABSTRACT

An electronic chime for generating an aural tone comprising an oscillator, an input signal generator for the oscillator, the input signal generated thereby decaying from an initial value to a lower value. The oscillator includes a signal processor (i.e., an amplifier) with a feedback frequency generator connected to the input of the amplifier and being responsive to the output of the amplifier for impressing a desired frequency on the input signal to the amplifier. A speaker and a driver for the speaker are provided, the latter being responsive to the output of the oscillator so as to sound a chime-like aural signal whose amplitude (volume) decays at a predetermined rate while the frequency of the signal remains substantially constant.

28 Claims, 4 Drawing Figures

ELECTRONIC CHIME

BACKGROUND OF THE INVENTION

This invention relates to an electronic circuit for producing a chime-like tone, and more particularly to an electronic chime.

Electrically operated aural signals are often used as warning signals or remainders. In contemporary automobiles, aural warnings are sounded when the car is started and the seatbelt/shoulder harness is not properly fastened or when the driver's door is open and the keys are in the ignition. Conventionally, a buzzer signal has been used to sound the aural reminder. While buzzers are inexpensive, reliable, and may be readily incorporated in automotive electrical systems, the buzzer sound is considered by many to be raucous and annoying.

In certain, more expensive automobiles, the buzzer has been replaced by an electromechanical chime having a chime bar which is struck by an electrically actuated hammer or plunger. While this electromechanical chime does produce a more pleasing tone, it suffers from many operating disadvantages compared with buzzer warning systems. First, known electromechanical chime systems are relatively large in size and heavy compared to a buzzer. Typically, these prior electromechanical chimes utilize a solenoid-operated hammer which when energized strikes a chime bar. It is necessary to provide a resonance chamber for the chime bar. It has been found that operation of this solenoid-operated hammer is sensitive to its orientation or position. If, for example, an automobile in which the electromechanical chime is installed is parked on an incline, the hammer may not properly sound the chime. If a multi-tone chime is desired, a separate chime bar, hammer, and resonance chamber is required for each desired tone. Still further, these prior electromechanical chimes incorporated movable parts (e.g., the hammer) which would, on occasion, stick or otherwise malfunction.

In recent years, several electronic chime circuits have become known. However, for the most part, they have either been overly complicated (and therefore expensive) or they have not produced a pleasing chime-like tone. Reference may be made to such U.S. Pat. Nos. as 3,653,040, 3,912,952, 3,971,016, 4,001,816 and 4,012,702 which disclose various prior art electronic chimes and other electronic aural devices in the same general field as the present invention.

SUMMARY OF THE INVENTION

Among the several objects and features of this invention may be noted the provision of an elecronic chime which requires no chime bar, no resonance chamber, and no moving parts (other than the cone of an electromagnetic speaker);

The provision of such an electronic chime which may be selectively operated to produce multi-tone chimes and to produce chimes of a desired loudness (i.e., volume);

The provision of such an electronic chime which consumes considerably less power (about 1/10) than prior electromechanical chimes;

The provision of such an electronic chime which is not position sensitive and which operates satisfactorily in any orientation;

The provision of such an electronic chime which requires considerably less space than prior art electromechanical chimes;

The provision of such an electronic chime which is substantially more reliable in operation than prior electromechanical chimes;

The provision of such an electronic chime which may be easily adjusted to emit a pleasing chime-like tone of substantially any desired frequency or pitch; and The provision of such an electronic chime which may be readily and economically manufactured and which may be readily incorporated in automotive electrical systems or the like.

Briefly, an electronic chime of this invention is adapted to be connected to a source of power (e.g., a DC electrical system in an automobile or the like) for sounding a chime-like aural signal whose amplitude (volume) decays at a predetermined rate while the frequency of the signal remains substantially constant. The electronic chime comprises an oscillator having an input and an output. Means is provided for generating an input signal for the oscillator, the input signal decaying from an initial value to a lower value. The oscillator includes a signal processor (or amplifier) with feedback means connected to the input of the amplifier and responsive to the output of the amplifier for impressing a desired frequency upon the input signal fed into the amplifier. A speaker and means for driving the speaker are also provided, the speaker driver means being responsive to the output of the oscillator.

Other objects and features of this invention will be in part apparent and in part pointed hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
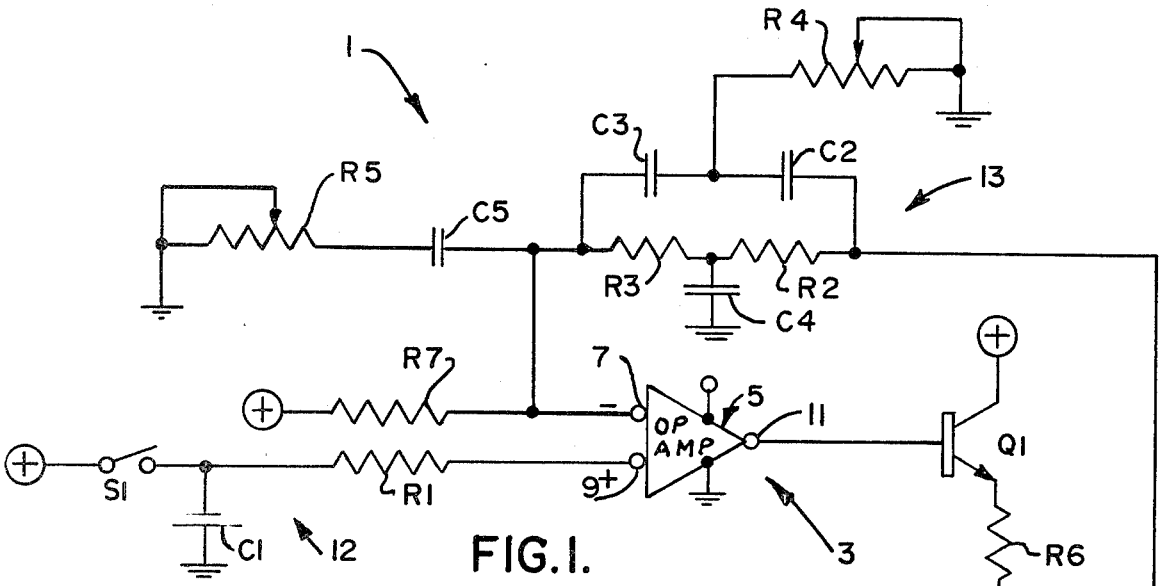
FIG. 1 is a diagrammatic representation of an electronic circuit of this invention for producing an electronically generated chime-like tone.
Figure 4:
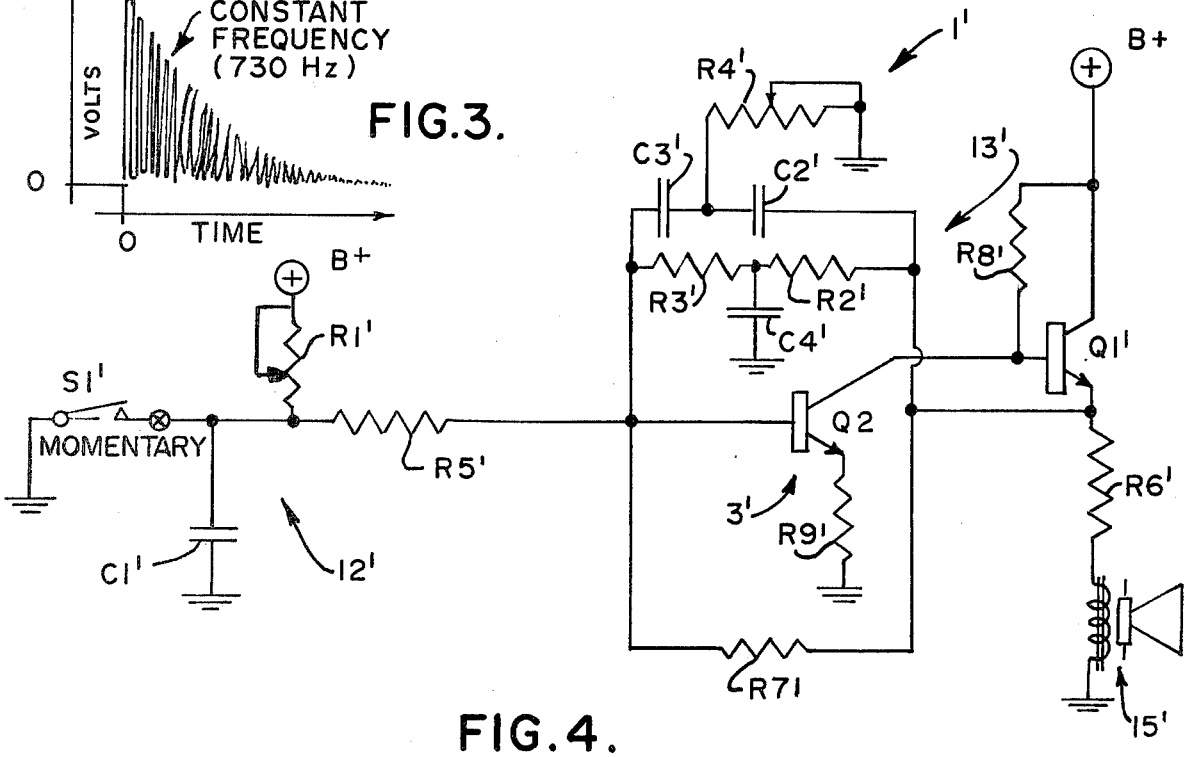
FIG. 4 is another embodiment of an electronic chime device of this invention.

Referring now to the drawings, and more particularly to FIGS. 1 and 4, circuits for an electronic chime of this invention are diagrammatically depicted. The chime circuit illustrated in FIG. 1 is indicated in its entirety by reference character 1 and the embodiment of the chime circuit shown in FIG. 4 is indicated in its entirety by reference character 1'. These two electronic chime circuits are similar in design and operation. Chime circuit 1 will be initially described and differences between the operation and construction of chime circuits 1 and 1' will be specifically pointed out hereinafter.

In general, a chime tone may be characterized as having a loud initial tone (as when a chime bar is mechanically struck by a hammer or the like) with the volume of the chime tone decaying as the chime bar continues to vibrate in its holder and as it is damped. Typically, the chime bar will continue to vibrate at a substantially constant frequency (as determined by the physical characteristics of the chime bar) while the volume of the chime tone decays or trails off. In general, the volume of the chime tone decays at an exponential rate as determined by its damping coefficients. The electronic chime of the present invention emulates the sound (tone) of a mechanical chime by driving a speaker at a desired frequency while decreasing (preferably exponentially) the voltage signal driving the speaker.

Turning now to FIG. 1, electronic chime 1 of the present invention is shown to include a sinusoidal oscillator, as generally indicated at 3, having an input and an output. In particular, oscillator 3 is shown in FIG. 1 to comprise an operational amplifier 5 (sometimes generically referred to as a signal processor) having an inverting input connection 7, a non-inverting input connection 9, and an output connection 11.

Figure 2:
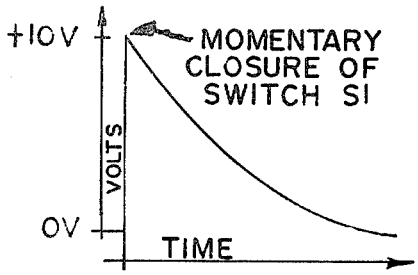
FIG. 2 is a plot of an input voltage signal of the circuit shown in FIG. 1 illustrating the decay of the input voltage signal as a function of time.
Figure 3:
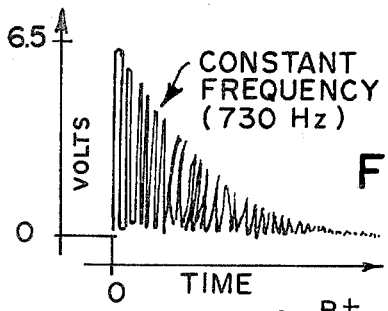
FIG. 3 is a plot of the voltage applied to an electromagnetic speaker of the electronic chime illustrated in FIG. 1 showing a constant frequency impressed thereon and showing the decay of this voltage (and thus the volume or loudness of the speaker output) as a function of time.

As generally indicated at 12, a resistor/capacitor circuit is connected to non-inverting input connection 9 of operational amplifier 5 for generating an input voltage signal which decays (preferably exponentially) from an initial voltage level (shown in FIG. 3 as 10 volts) at a predetermined rate. This resistor/capacitor input circuit 12 includes a resistor R1 and a capacitor C1 connected to ground. A momentary, normally open switch S1 is connected between resistor R1 and capacitor C1 and further is connected to a DC power source. Upon the momentary making of switch S1, which may be remotely actuated, capacitor C1 will be momentarily charged to an initial value. Upon switch S1 opening, capacitor 1 with discharge through resistor R1 and the voltage signal applied to input terminal 7 of operational amplifier 5 will decay at a predetermined rate generally in accordance with the exponential decay curve shown in FIG. 2. It will be noted that resistor R1 determines the time decay of the voltage input signal and the characteristics of the decay time of the voltage input signal may be changed by changing values of resistor R1. As shown in FIG. 4, resistor R1' is an adjustable resistor thereby enabling one to selectively set the characteristics of the time decay of the voltage input signal. By way of example, resistor R1 in FIG. 1 may be selected to have a resistance of 1 megaohm and capacitor C1 may be selected so as to have a capacitance of 1 microfarad. It will be understood that the values for the capacitors, resistors, and the characteristics of the other components herein described are only for purposes of example and that other values could be substituted.

As generally indicated at 13, oscillator 3 includes a so-called feedback frequency generator is connected to the inverting input connection 7 of operational amplifier 5 and responsive to the output of the operational amplifier for impressing a desired frequency on the voltage input signal fed from the resistor/capacitor circuit 12. Frequency generator 13 is shown to be a resistor/capacitor network or bridge, and more particularly shown to be as a twin-T network having two parallel branches, i.e., a capactive branch and a resistive branch. The capacitive branch has two series connected capacitors C2 and C3 and the resistive branch has two series connected resistors R2 and R3. A grounded adjustable resistor R4 is connected between capacitors C2 and C3 and a grounded capacitor C4 is connected between resistors R2 and R3. Resistor R4 is shown to be an adjustable resistor so as to vary the frequency of the feedback frequency generator. Resistors R2 and R3 and capacitors C2, C3 and C4 together determined the operational characteristics of the twin-T network. For example, resistors R2 and R3 may each have resistances of about 150,000 ohms and capacitors C2, C3 and C4 may be selected to each have a capacitive value of about 0.002 microfarads. With this arrangement, adjustable resistor R4 may be so adjusted as to impress a frequency of about 730 Hz on the voltage input signal fed into operational amplifier 5.

Another adjustable resistor R5 is interconnected between twin-T network 13 and input terminal 9 of operational amplifier 5. This adjustable resistor sets the loop gain for the twin-T network. Preferably, this resistor is so adjusted as to set the loop gain at approximately 1 thereby to minimize the distortion in the loop. A capacitor C5 is connected between network 13 and resistor R5 so as to remove resistor R5 from the d.c. feedback circuit.

A transistor Q1 (referred to as a second amplifier) is connected to the output 11 of the operational amplifier 5. For example, transistor Q1 may be a 2N3415 transistor and serves to drive an electromagnetic speaker as generally indicated at 15. For example, speaker 15 may be a two inch speaker having a resistance of 45 ohms. The base of transistor Q1 is directly connected to output terminal 11 of operational amplifier 5 and its collector is connected to a positive DC power source. The emitter of transmitter Q1 drives speaker 15 via a resistor R6 (e.g., a 10 ohm resistor) which functions to set the output level of transistor Q1. Another resistor R7 is connected to input terminal 9 of operational amplifier 5 and serves to set the minimum bias on transistor Q1. For example, resistor R7 may have a value of about 10 megaohms.

As shown in FIG. 1, the input to feedback frequency generator 13 is connected between resistor R6 and speaker 15. However, this connection is responsive to the output of the operational amplifier and thus the feedback frequency generator is in effect connected between the output and the input of operational amplifier 5.

Referring now to the other embodiment 1' of the electronic chime of this invention (as shown in FIG. 4), components similar in function to the components heretofore described in regard to the circuit shown in FIG. 1 are identified by "primed" reference numbers and only important operational and structural differences will now be described in detail.

Oscillator 13' is herein shown to include an amplifier transistor Q2, such as a C1851 transistor, in place of operational amplifier 5. This amplifier transistor Q2 may also be referred to as a signal processor. Input voltage signal decay means 12' (i.e., momentary switch S1', resistor R1', and capacitor C1') is connected to the base of transistor Q2 through resistor R5'.

Resistor/capacitor network 13' constituting the feedback frequency generator is again shown to be a twin-T network. Resistor R5' sets the loop gain on network 13'. Resistors R1' and R5' set the minimum bias of speaker driver transistor Q1'. As shown, the input to the feedback frequency generator 13' is directly connected to the output of the emitter of transistor Q1'. The collector of transistor Q2 is directly connected to the base of transistor Q1' and to resistor R8'. The emitter of transistor Q2 is connected to ground through resistor R9' which improves d.c. stability.

While the resistor capacitor network 13 was herein described as a twin-T, it will be understood that within the broader aspects of this invention other sinusoidal resistive/capacitive (RC) frequency feedback networks may be satisfactorily employed.

It will also be further understood that the electronic chime of this invention may be readily adapted to emit a multi-tone chime aural signal. This may be accomplished by providing two or more resistors in place of resistor R4 in FIG. 1 that may be selectively switched in and out of the twin-T network thereby to vary the frequency impressed on the voltage input signal into oscillator 3. It will thus be appreciated that with the circuit of this invention, a multitone chime-like signal may be emitted substantially without requiring additional components.

In view of the above, it will be seen that the other objects of the invention are achieved and other advantageous results are attained.

As various changes could be made in the above constructions without departing from the scope of the invention, it is intended that all matter contained in the above description or shown in the accompanying drawings shall be interpreted as illustrative and not in a limiting sense.

I claim:

1. An electronic chime adapted to be connected to a source of power for sounding a chime-like aural signal whose amplitude decays at a predetermined rate while the frequency of said aural signal remains substantially constant, said electronic chime comprising:

an oscillator including an amplifier having an input and an output;

means for generating an input voltage signal for said oscillator, said input voltage signal decaying from an initial value;

feedback means connected to said amplifier input and responsive to the output of said amplifier for impressing a desired frequency upon said voltage input signal; and a speaker responsive to the output of said oscillator.

2. An electronic chime as set forth in claim 1 wherein said decaying input signal generating means comprises a resistor/capacitor circuit.

3. An electronic chime as set forth in claim 1 wherein said feedback frequency generating means comprises a resistor/capacitor network.

4. An electronic chime as set forth in claim 3 wherein said network is a twin-T network.

5. An electronic chime as set forth in claim 1 wherein said amplifier is an operational amplifier having an inverting input connection, a non-inverting input connection, and an output connection with said decaying input signal generating means being connected to said non-inverting input connection.

6. An electronic chime as set forth in claim 1 wherein said amplifier is a transistor having a base, a collector, and an emitter with said decaying input signal generating means being connected to said base and with said feedback frequency generating means being connected to between said base and said collector.

7. An electronic chime as set forth in claim 1 further comprising a second amplifier responsive to the output of said oscillator for driving said said speaker.

8. An electronic chime as set forth in claim 7 wherein the said second amplifier comprises a transistor having a base, a collector, and an emitter with the output of said oscillator connected to its base, with said collector adapted to be connected to a source of power, with said emitter connected to said speaker.

9. An electronic chime as set forth in claim 2 wherein said input signal resistor/capacitor circuit comprises a resistor and a capacitor series connected to one another with said capacitor connected to ground and with said resistor connected to the input of said amplifier.

10. An electronic chime as set forth in claim 9 further comprising a switch connected to ground, said switch being connected between said capacitor and said resistor and being operable so as to effect energization of said electronic chime.

11. An electronic chime as set forth in claim 10 wherein said switch is a momentarily closed, normally open switch.

12. An electronic chime as set forth in claim 7 wherein said feedback frequency generating means further includes means for setting the gain and bias on said speaker driver means.

13. An electronic chime as set forth in claim 3 wherein said feedback frequency generating means further includes means for controlling the frequency impressed on said voltage input signal to said amplifier.

14. An electronic chime as set forth in claim 13 wherein said resistor/capacitor network comprises a twin-T network having two parallel branches, one of said branches having two series connector capacitors therein with a grounded resistor between said capacitors, this grounded resistor constituting means for controlling the frequency impressed on said amplifier, and the other of said branches having two series connected resistors therein with a grounded resistor connected therebetween.

15. An electronic chime as set forth in claim 14 wherein said grounded resistor is adjustable so as to permit the frequency impressed on said input signal to be selectively varied.

16. An electronic chime as set forth in claim 14 further comprising means responsive to the output of said oscillator for driving said speaker, and a grounded resistor connected between said resistor/capacitor network and the input of said amplifier for setting the loop gain and bias of said speaker drive means.

17. An electronic chime as set forth in claim 16 wherein said grounded resistor is adjustable.

18. An electronic chime as set forth in claim 7 wherein said second amplifier means comprises a transistor having a base, a collector, and an emitter with the output of said amplifier connected to said base, with its collector adapted to be connected to a source of power, and with its emitter connected to said speaker.

19. An electronic chime comprising means for momentarily making a DC circuit and a speaker adapted to emit a chime-like aural signal whose volume decays at a predetermined rate while the frequency of said signal remains substantially constant, said chime further comprising an operational amplifier having an inverting input connection, a non-inverting input connection, and an output connection, said momentary making means and DC power source supplying an initial voltage input signal to said non-inverting connection of said operational amplifier, decay means for decreasing said initial input voltage signal, and feedback frequency generating means connected to said non-inverting input and responsive to the output of said operational amplifier for impressing a substantially constant frequency on said initial voltage input signal, said speaker being responsive to said output of said operational amplifier.

20. An electronic chime as set forth in claim 19 wherein said momentary making means comprises a normally closed, momentary switch.

21. An electronic chime as set forth in claim 19 wherein said feedback frequency generating means comprises a resistor/capacitor bridge.

22. An electronic chime as set forth in claim 19 further comprising means connected to said output of said operational amplifier for driving said speaker.

23. An electronic chime comprising means for momentarily making a DC power circuit and a speaker adapted to emit a chime-like aural signal whose volume decays at a predetermined rate while the frequency of said signal remains substantially constant, said electronic chime further comprising an operational amplifier having two input connections and an output connection, said switch and DC power source supplying an initial voltage input to one of said input connections of said operational amplifier, decay means for decreasing said initial input voltage signal, means connected to said output of said operational amplifier for driving said speaker, and feedback frequency generating means connected between an output of said speaker driver means and the other of said inputs of said operational amplifier.

24. A device for emulating and emitting a chime-like tone, said device being adapted to be connected to a source of DC electrical power and comprising means for momentarily making a DC power circuit and for generating an initial input voltage signal, a speaker adapted to emit an aural chime-like tone upon the momentary making of said DC power circuit, a signal processor having an input and an output, said input receiving said input voltage signal, decay means for decreasing said input voltage signal, feedback frequency generating means connected to the input of said signal processor and being responsive to the output of said signal processor for impressing a substantially constant frequency upon said input voltage signal, and means connected to the output of said signal processor for driving said speaker whereby upon the momentary making of said DC power circuit said speaker emits a tone having an initial loud volume which decays in response to the decay of said input voltage signal and having substantially constant frequency.

25. A device as set forth in claim 24 wherein said signal processor is a transistor having a base, an emitter, and a collector, the latter constituting the output of said amplifier, said momentary making means and said decay means being connected to said base, said feedback frequency generating means being connected between said collector in said base, said emitter being connected to said ground.

26. A device as set forth in claim 25 further comprising a diode connected between said emitter and ground.

27. A device as set forth in claim 25 wherein said feedback frequency generating means comprises a resistor/capacitor bridge.

28. A device as set forth in claim 24 wherein said signal processor is an operational amplifier having an inverting input, a non-inverting input, and an output, said momentary making means and said decay means being connected to said inverting input, said feedback frequency generating means being connected to said non-inverting input and being responsive to the output of said operational amplifier.

* * * * *

UNITED STATES PATENT AND TRADEMARK OFFICE

CERTIFICATE OF CORRECTION

PATENT NO. : 4,215,339

DATED : July 29, 1980

INVENTOR(S) : John E. Durkee

It is certified that error appears in the above–identified patent and that said Letters Patent are hereby corrected as shown below:

Column 4, line 9, "0.002" should be "0.0022"

Signed and Sealed this

*Third* Day of *March 1981*

[SEAL]

*Attest:*

RENE D. TEGTMEYER

*Attesting Officer*

*Acting Commissioner of Patents and Trademarks*